United States Patent [19]

Guzik et al.

[11] Patent Number: 4,751,481

[45] Date of Patent: Jun. 14, 1988

[54] MOLDED RESONATOR

[75] Inventors: Andrzej T. Guzik, Pompano Beach; Alvin D. Kluesing; Joseph A. Budano, II, both of Plantation; Robert S. Kaltenecker, Tamarac, all of Fla.

[73] Assignee: Motorola, Inc., Schaumburg, Ill.

[21] Appl. No.: 947,016

[22] Filed: Dec. 29, 1986

[51] Int. Cl.[4] ..... H01P 7/08; H01P 11/00

[52] U.S. Cl. ..... 333/222; 29/600; 333/204; 333/246

[58] Field of Search ..... 333/202–208, 333/238, 245, 246, 219, 222, 223, 235; 29/600, 601, 841, 829, 834, 835, 592

[56] References Cited

U.S. PATENT DOCUMENTS

| | | | |
|---|---|---|---|
| 3,142,808 | 7/1964 | Gonda | 333/204 |
| 3,512,254 | 5/1970 | Jenkins et al. . | |
| 3,534,301 | 10/1970 | Golembeski | 333/204 |
| 3,590,329 | 6/1971 | Krepps, Jr. | 29/605 X |
| 3,617,955 | 11/1971 | Masland | 336/208 X |
| 3,774,221 | 11/1973 | Francis | 343/895 X |
| 3,990,024 | 11/1976 | Hou | 333/238 |
| 4,152,679 | 5/1979 | Chen | 333/204 X |
| 4,193,185 | 3/1980 | Liautaud . | |
| 4,266,206 | 5/1981 | Bedard et al. | 333/204 |
| 4,398,164 | 8/1983 | Nishikawa et al. | 333/206 X |
| 4,484,159 | 11/1984 | Whitley | 333/206 X |
| 4,560,965 | 12/1985 | Gosling et al. | 333/219 |
| 4,563,662 | 1/1986 | Thorpe | 333/219 |
| 4,603,023 | 7/1986 | Mack et al. | 333/245 X |
| 4,603,311 | 7/1986 | Mage | 333/202 |
| 4,609,892 | 9/1986 | Higgins, Jr. | 333/204 |
| 4,614,922 | 9/1986 | Bauman et al. | 333/161 |

FOREIGN PATENT DOCUMENTS

| | | | |
|---|---|---|---|
| 798629 | 7/1958 | United Kingdom | 333/204 |
| 886311 | 1/1962 | United Kingdom | 333/245 |

*Primary Examiner*—Marvin L. Nussbaum

*Attorney, Agent, or Firm*—Daniel K. Nichols; Joseph T. Downey; Anthony J. Sarli

[57] ABSTRACT

The molded resonator includes at least one formed resonator element having an resonator portion and opposed end leg portions which provide electrical connections to the main portion. A dielectric portion is molded about the resonator element. A conductive ground plane is carried by the dielectric portion and electrically shields the resonator element. The resonator element is formed of wire having a circular cross-section.

9 Claims, 2 Drawing Sheets

MOLDED RESONATOR

BACKGROUND OF THE INVENTION

This invention relates to transmission line resonators in general and particularly to molded resonators. Prior art transmission line resonators, such as stripline resonators having solid dielectric materials were constructed by a lamination process. For example, in one known method, a circuit trace is formed on a dielectric substrate, a second dielectric substrate is placed over and bonded to the first substrate, and an outer ground plane is then bonded to the substrates. This prior art approach includes a number of limitations such as expense of manufacture, limited electrical specifications, difficulties in making the external connections to the stripline elements, and microphonics (i.e. electrical instability during mechanical vibration). These limitations are overcome by the molded resonator.

SUMMARY OF THE INVENTION

This molded resonator includes at least one preformed resonator element that is molded into a monolithic dielectric structure.

This molded resonator includes at least one formed resonator element having a main resonator portion and opposed end leg portions for providing electrical connections to the main portion. The dielectric material is molded about the resonator element. A conductive ground plane is carried by the dielectric portion and electrically shields the resonator element.

In one aspect of the invention, the resonator element is formed of wire having a circular cross-section. In another aspect of the invention, the resonator includes two formed resonator elements. In still another aspect of the invention, one of the leg portions is connected to the conductive ground plane.

A method of manufacturing a resonator includes the steps of forming at least one resonator element; placing the one resonator element in a mold; injecting a dielectric material to form a first molded member having corner support portions for precisely locating the member in a second mold; placing the first molded member in a second mold and injecting additional dielectric material to form a second molded member; and metallizing the second molded member to provide a ground plane for shielding the resonator element.

In one aspect of the method of manufacturing a resonator, the first molding member is formed with through holes and the additional dielectric materials is injected into the through holes thereby interconnecting the additional dielectric material on opposite sides of the resonator.

DESCRIPTION OF THE PREFERRED EMBODIMENT

Figure 1:
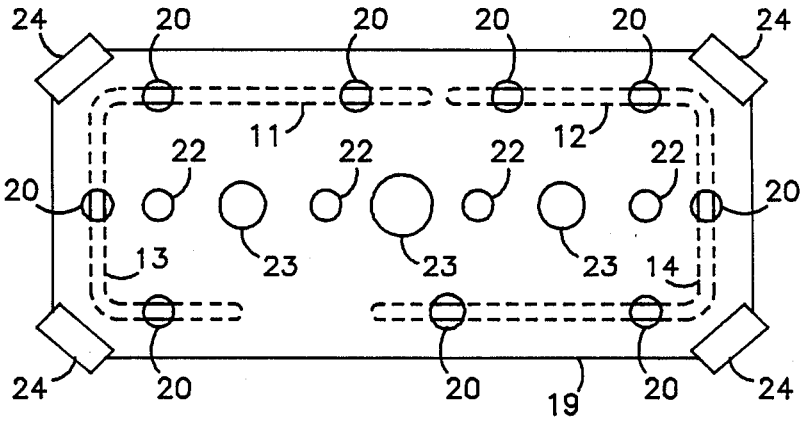
FIG. 1 is a top plan view of a molded resonator after the first molding operation.

Referring now by characters of reference to the drawings and first to FIG. 1, it will be understood that the molded resonator includes first and second resonator elements 11 and 12 that are preformed into predetermined shapes for providing desired electrical characteristics. The resonator elements 11 and 12 are formed of conductive material which, in the preferred embodiment, is hard drawn copper wire having a circular cross-section. While two resonator elements are illustrated in the preferred embodiment, a single resonator element or three or more can be utilized.

Each of the resonator elements 11 and 12 includes a main resonator portion, 13 and 14 respectively, which is formed in a single plane. In the illustrated embodiment, both portions 13 and 14 are substantially "U" shaped. Any other shape including a straight line can be utilized provided the shape and length are properly choosen to achieve the desired electrical characteristics in the finished resonator.

Figure 2:
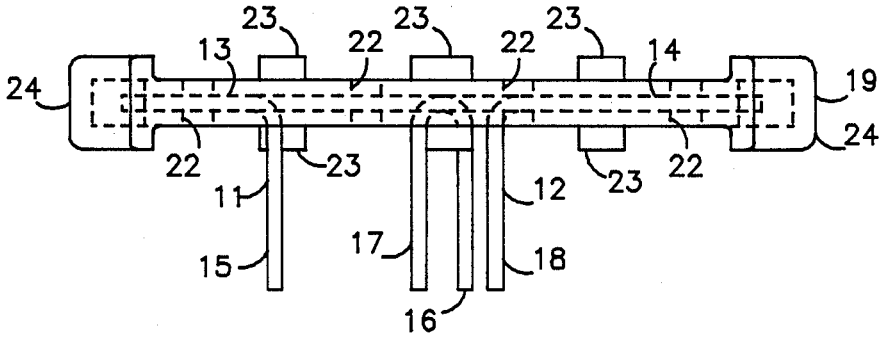
FIG. 2 is a side elevational view of the molded resonator of FIG. 1.
Figure 3:
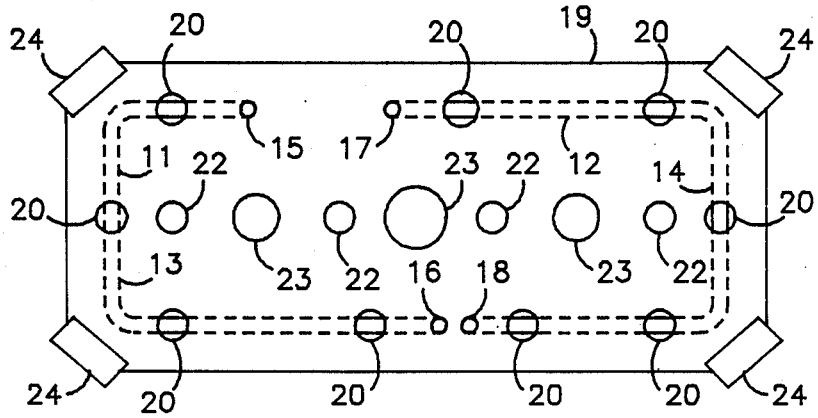
FIG. 3 is a bottom plan view of the molded resonator of FIG. 1.

As more clearly illustrated in FIGS. 2 and 3, resonator element 11 includes depending legs 15 and 16 located at opposite ends of the main resonator portion 13 and extending substantially perpendicular to the plane of the main portion 13. Likewise, resonator element 12 includes, depending legs 17 and 18. The legs 15–18 provide the necessary electrical connections between the resonator main portions 13 and 14 and external circuits.

The resonator elements 11 and 12 are placed in a precision mold (not shown) which locates the legs 15–18 while opposed side mold locating pins clamp and support the main resonator portions 13 and 14 in a precise predetermined location. A dielectric material is then injected into the mold to form the first molded member 19. After the first molding operation, the first molded member 19 has a plurality of holes 20 resulting from the mold locating pins that engage the main portions 13 and 14. Through holes 22 are provided in the first molded member 19, which also includes support protrusions 23 used for mechanical support in the second molding operation as well as, corner support portions 24 that are used to provide for exact location of the first molded portion 19 during the second molding operation.

Figure 4:
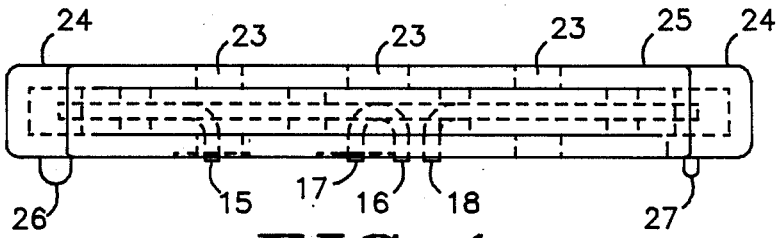
FIG. 4 is a side elevational view of the molded resonator after the second molding operation.
Figure 5:
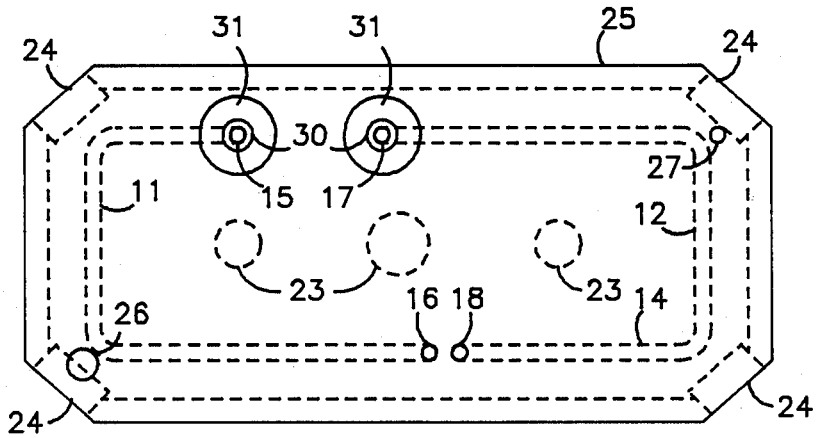
FIG. 5 is a bottom plan view of the molded resonator of FIG. 4.
Figure 6:
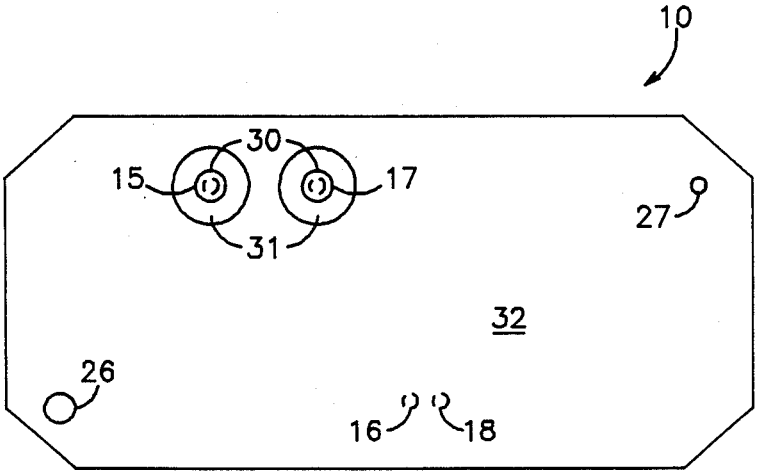
FIG. 6 is a bottom plan view of the completed molded resonator.

The first molded portion 19 is then placed in a second mold (not shown) and additional dielectric material is injected to form the second molded member 25, illustrated in FIGS. 4 and 5. The second molded member 25 provides a substantially parallelepiped structure that includes on its lower surface, two locating protrusions 26 and 27 used for positioning the molded resonator when used in a circuit such as a two-way portable radio. The legs 15–18 are sheared off substantially even with the surface of the second molded member 25. At legs 15 and 17, the second molded member 25 includes island portions 30 that have their surfaces in the plane of the surface of the second molded member. The island portions 30 are surrounded by ring depressions 31 in the surface of second molded member 25. A layer of resist material is deposited in the depressions 31. The exterior of a second molded member 25 is then metallized as by sputtering to provide an electrical shield or ground plane 32 around the resonator elements 11 and 12 thereby completing the molded resonator 10, as illustrated in FIG. 6.

The metallized ground plane 32 makes electrical connection to the legs 16 and 18. The metallization at islands 30 provides electrical connection to legs 15 and 17. The resist in depressions 31 prevent metallization of that area thereby electrically isolating islands 30 from the ground plane 32 on the surfaces of molded resonator 10. In the event that the legs 16 and 18 are not to be grounded, they can also be connected at islands 30 like legs 15 and 18.

It is thought that the structural feature and functional advantages of the improved molded resonator have become fully apparent from the foregoing description of parts, but for completeness of disclosure a brief description of the manufacture operation of the resonator will be given. It will be understood that the particular form of the resonator elements 13 and 14 depend upon the desired operating characteristics of the molded resonator 10. The arrangement once chosen provides a high Q resonator due in part to the circular cross-section of the resonator elements 11 and 12.

The first molding, illustrated in FIGS. 1–3, is used for the precise positioning of the resonator elements 11 and 12. During the second molding the corner portions 24 are used to precisely locate and support the first molded member 19 in the mold. The protrusions 23 by engaging the mold prevent flexing, bending or movement of the first molded member 19 during the high pressure molding operation. During the second molding operation, a substantially continuous and smooth outer surface is formed to provide a uniform surface for the application of the metallized ground plane 32 to complete the resonator 10. The support protrusions 23 and, corner support portions 24 are spaced from the resonator elements 11 and 12. This spacing is important to minimize the effects of discontinuities in the ground plane 32 that can exist at boundaries of the dielectric material from the first and second molding processes.

The through holes 22 provide direct interconnection of the dielectric material of the second molding process in addition to the interconnection that occurs at the periphery of the second molded member 25, thereby providing increased structural integrity of the resonator. In the preferred embodiment, the dielectric material used in both molding processes is polyetherimide having a 10% fiberglass content such as that sold under the tradename ULTEM 2100 by General Electric Company.

After metallization, the high Q, mechanically stable resonator 10 can be incorporated into a circuit such as a two-way portable radio by making electrical connections at pads 30 and to the ground plane 32.

We claim as our invention:

1. A molded resonator comprising:

at least one formed resonator element having a main resonator portion and opposed end leg portions providing electrical connection to the main portion, a dielectric portion molded about the resonator element, including a first molding of dielectric material in which the resonator is precisely positioned, and a second molding of dielectric material providing a substantially continuous and smooth outer surface, and a conductive ground plane carried by the dielectric portion outer surface electrically shields the resonator element.

2. A molded resonator as defined in claim 1, in which the resonator element is formed of wire having a circular cross-section.

3. A molded resonator as defined in claim 1, further comprising two formed resonator elements.

4. A molded resonator as defined in claim 1, in which one of the leg portions is connected to the conductive ground plane.

5. A molded resonator as defined in claim 1, in which the resonator element is formed of wire having a circular cross-section, and one of the leg portions of the resonator element is connected to the ground plane.

6. A method of manufacturing a resonator comprising the steps of:

forming at least one resonator element, placing said at least one resonator element in a mold and injecting a dielectric material to form a first molded member having corner support portions for precisely locating the member in a second mold;

placing the first molded member in a second mold and injecting additional dielectric material to form a second molded member; and metallizing the second molded member to provide a ground plane for shielding the resonator element.

7. The method of claim 6 in which the first molded member is formed with through holes and the additional dielectric material is injected into the through holes thereby interconnecting the additional dielectric material on opposite sides of the resonator.

8. A method of manufacturing a resonator comprising the steps of:

forming at least one resonator element, placing said at least one resonator element in a mold and injecting a dielectric material to form a first molded member having support portions for precisely locating the member in a second mold;

placing the first molded member in a second mold and injecting additional dielectric material to form a second molded member; and metallizing the second molded member to provide a ground plane for shielding the resonator element.

9. The method of claim 8 in which the support portions of the first molded members are spaced from said resonator element.

* * * * *